US009361835B2

(12) United States Patent
Ueno et al.

(10) Patent No.: US 9,361,835 B2
(45) Date of Patent: Jun. 7, 2016

(54) IMAGE DISPLAY DEVICE AND IMAGE DISPLAY METHOD

(75) Inventors: Tetsuya Ueno, Osaka (JP); Kohji Fujiwara, Osaka (JP)

(73) Assignee: SHARP KABUSHIKI KAISHA, Osaka-Shi (JP)

( * ) Notice: Subject to any disclaimer, the term of this patent is extended or adjusted under 35 U.S.C. 154(b) by 297 days.

(21) Appl. No.: 13/579,876

(22) PCT Filed: Nov. 17, 2010

(86) PCT No.: PCT/JP2010/070442
§ 371 (c)(1),
(2), (4) Date: Aug. 17, 2012

(87) PCT Pub. No.: WO2011/111268
PCT Pub. Date: Sep. 15, 2011

(65) Prior Publication Data

US 2012/0320105 A1 Dec. 20, 2012

(30) Foreign Application Priority Data

Mar. 12, 2010 (JP) ..... 2010-055395

(51) Int. Cl.
*G09G 5/10* (2006.01)
*G09G 3/34* (2006.01)
*G09G 3/36* (2006.01)

(52) U.S. Cl.
CPC ..... *G09G 3/3426* (2013.01); *G09G 3/3413* (2013.01); *G09G 3/3611* (2013.01); *G09G 2320/0276* (2013.01); *G09G 2320/066* (2013.01); *G09G 2320/0626* (2013.01); *G09G 2320/0646* (2013.01);

(Continued)

(58) Field of Classification Search
CPC ..... G09G 2320/0276; G09G 2360/16; G09G 2320/0626; G09G 3/3648; G09G 3/3611; G09G 3/3406; G09G 2320/0646; G09G 2330/021; G09G 2320/064
See application file for complete search history.

(56) References Cited

U.S. PATENT DOCUMENTS

2004/0201561 A1* 10/2004 Funamoto et al. ..... 345/89
2004/0212739 A1 10/2004 Kiuchi et al.

(Continued)

FOREIGN PATENT DOCUMENTS

JP 2004-326082 11/2004
JP 2009-198530 9/2009

(Continued)

OTHER PUBLICATIONS

International Search Report mailed Feb. 22, 2011, directed to International Application No. PCT/JP2010/070442; 4 pages.

*Primary Examiner* — Lixi C Simpson
*Assistant Examiner* — Ngan T Pham Lu
(74) *Attorney, Agent, or Firm* — Morrison & Foerster LLP

(57) ABSTRACT

In the present liquid crystal display device, an LED output value correction section (513) included in an area-active drive processing section (5) corrects LED data Dbl obtained by an LED output value calculation section (512) with reference to a luminance correction LUT (13), such that the luminance in the area from an intermediate value to near a maximum value shifts to a higher degree. Thus, even if the backlight luminance is low (typically, the mean luminance of an input image is low), contrast ratio is enhanced, thereby preventing a tone jump (insufficient luminance) at high tone levels due to an insufficient backlight luminance.

13 Claims, 9 Drawing Sheets

(52) U.S. Cl.
CPC ..... *G09G 2330/021* (2013.01); *G09G 2360/16* (2013.01); *G09G 2360/18* (2013.01)

(56) References Cited

U.S. PATENT DOCUMENTS

| | | | | |
|---|---|---|---|---|
| 2008/0180384 | A1* | 7/2008 | Aoki et al. | 345/102 |
| 2009/0174638 | A1* | 7/2009 | Brown Elliott et al. | 345/88 |
| 2009/0284545 | A1* | 11/2009 | Watanabe et al. | 345/589 |
| 2010/0053066 | A1 | 3/2010 | Nonaka et al. | |
| 2010/0225574 | A1 | 9/2010 | Fujiwara et al. | |
| 2010/0309107 | A1 | 12/2010 | Muroi et al. | |

FOREIGN PATENT DOCUMENTS

| | | |
|---|---|---|
| WO | WO-2008/001512 | 1/2008 |
| WO | WO-2009/096068 | 8/2009 |
| WO | WO-2009/101727 | 8/2009 |

* cited by examiner

14

| | | | | |
|---|---|---|---|---|
| 0 | 0 | 10 | 0 | 0 |
| 0 | 30 | 50 | 30 | 0 |
| 10 | 50 | 100 | 50 | 10 |
| 0 | 30 | 50 | 30 | 0 |
| 0 | 0 | 10 | 0 | 0 |

IMAGE DISPLAY DEVICE AND IMAGE DISPLAY METHOD

REFERENCE TO RELATED APPLICATIONS

This application is a national stage application under 35 USC 371 of International Application No. PCT/JP2010/070442, filed Nov. 17, 2010, which claims the priority of Japanese Patent Application No. 2010-055395, filed Mar. 12, 2010, the entire contents of which are incorporated herein by reference.

FIELD OF THE INVENTION

The present invention relates to image display devices, particularly to an image display device with the function of controlling the luminance of a backlight (backlight dimming function).

BACKGROUND OF THE INVENTION

Image display devices provided with backlights, such as liquid crystal display devices, can control the luminances of the backlights on the basis of input images, thereby suppressing power consumption by the backlights and improving the quality of display images. In particular, by dividing a screen into a plurality of areas and controlling the luminances of backlight sources corresponding to the areas on the basis of portions of an input image within the areas, it is rendered possible to achieve lower power consumption and higher image quality. Hereinafter, such a method for driving a display panel while controlling the luminances of backlight sources on the basis of input image portions within areas will be referred to as "area-active drive".

Liquid crystal display devices of area-active drive type use, for example, LEDs (light emitting diodes) of three colors, i.e., R, G and B, and LEDs of white as backlight sources. Luminances of LEDs corresponding to areas are obtained on the basis of, for example, maximum or mean pixel luminances within the areas, and provided to a backlight driver circuit as LED data. In addition, display data (data for controlling the light transmittance of the liquid crystal) is generated on the basis of the LED data and an input image, and the display data is provided to a liquid crystal panel driver circuit. Note that the luminance of each pixel on the screen is the product of the luminance of light from the backlight and the light transmittance based on the display data. Here, light emitted by one LED is incident on a plurality of areas around one corresponding area. Accordingly, the luminance of each pixel is the product of the total luminance of light emitted by a plurality of LEDs and the light transmittance based on the display data.

In the liquid crystal display devices as mentioned above, the display data and the LED data are appropriately obtained on the basis of an input image, the light transmittance of the liquid crystal is controlled on the basis of the display data, and luminances of LEDs corresponding to areas are controlled on the basis of the LED data, so that the input image can be displayed on the liquid crystal panel. In addition, when luminances of pixels within an area are low, luminances of LEDs corresponding to that area are kept low, thereby reducing power consumption by the backlight.

In relevance to such area-active drive liquid crystal display devices, for example, International Publication WO2009/096068 pamphlet discloses the configuration of a conventional image display device (hereinafter, the device will be referred to as the "conventional device") in which upper and lower luminance limits are predetermined for use in obtaining light source luminances corresponding to areas. In the conventional device, in accordance with a mean image luminance, the upper luminance limit is determined to be lower than the maximum luminance, or the lower luminance limit is determined to be lower than the minimum luminance, thereby preventing a reduction in display quality.

Patent Document 1: International Publication WO2009/096068 pamphlet

SUMMARY OF THE INVENTION

However, in the conventional device, when the mean image luminance is low, a low backlight luminance results in a reduction in display quality, e.g., peak brightness of pixels to be displayed with high tones being perceived somewhat low, or when the backlight luminance is insufficient (for a display luminance), a tone jump (insufficient luminance) or suchlike might occur at pixels to be displayed with high tones.

In this regard, the issue with insufficient luminance can be solved by increasing the backlight luminance even if the mean luminance of an input image is low. However, such a constantly high backlight luminance increases power consumption, and the entirely bright screen causes the peak brightness to be perceived somewhat low.

Therefore, an objective of the present invention is to provide an image display device, and a control method thereof, in which the luminance of a backlight is controlled on the basis of an input image, so that a reduction in display quality due to a low backlight luminance can be prevented even when a mean luminance of the input image is low.

A first aspect of the present invention is directed to an image display device with a function of controlling a backlight luminance, comprising:

- a backlight including a light source;
- a display panel including a plurality of display elements for transmitting light from the light source therethrough in order to display a plurality of pixels;
- an emission luminance calculation section for obtaining emission luminance data indicating a luminance upon emission of the light source, on the basis of an input image including a plurality of pixels to be displayed with predetermined tones;
- a display data calculation section for obtaining display data in accordance with light transmittances of the display elements, on the basis of the input image and the emission luminance data obtained by the emission luminance calculation section;
- a panel driver circuit for outputting signals for controlling the light transmittances of the display elements to the display panel, on the basis of the display data; and
- a backlight driver circuit for outputting signals for controlling the luminance of the light source to the backlight, on the basis of the emission luminance data, wherein, the emission luminance calculation section includes:

- an output value calculation section for performing predetermined computation on the tones of the pixels included in the input image, thereby calculating the emission luminance data corresponding to the pixels, and
- a luminance correction section for correcting the input image to be provided to the output value calculation section or the emission luminance data calculated by the output value calculation section, such that values within a predetermined range of the emission luminance data to be provided to the display data calculation section are increased.

In a second aspect of the present invention, based on the first aspect of the invention, the luminance correction section adds a predetermined increment to values within a range from an intermediate value to near a maximum value of the emission luminance data to be provided to the display data calculation section.

In a third aspect of the present invention, based on the second aspect of the invention, the increment added to the values within said range by the luminance correction section is determined so as to be minimized at the intermediate value and near the maximum value, the intermediate value being a value greater than or equal to a median of the emission luminance data to be provided to the display data calculation section.

In a fourth aspect of the present invention, based on the first aspect of the invention, the luminance correction section adds a predetermined increment to values within a range from near a minimum value to an intermediate value of the emission luminance data to be provided to the display data calculation section.

In a fifth aspect of the present invention, based on the fourth aspect of the invention, the increment added to the values within said range by the luminance correction section is determined so as to be maximized near the minimum value of the emission luminance data to be provided to the display data calculation section, and minimized at the intermediate value.

In a sixth aspect of the present invention, based on the first aspect of the invention, the luminance correction section adds a predetermined increment to values within a range from near a minimum value to a first intermediate value of the emission luminance data to be provided to the display data calculation section, and also adds a predetermined increment to values within a range from a second intermediate value to near a maximum value, the second intermediate value being a value greater than or equal to the first intermediate value.

In a seventh aspect of the present invention, based on the sixth aspect of the invention, the increment added to the values within said range by the luminance correction section is determined so as to be maximized near the minimum value of the emission luminance data to be provided to the display data calculation section, and minimized at the first intermediate value, the second intermediate value, and near the maximum value.

In an eighth aspect of the present invention, based on the first aspect of the invention, the emission luminance calculation section performs a reverse gamma correction on an input image provided from outside the device, and the display data calculation section includes image memory for holding the input image provided from outside the device for a predetermined time period, a display reverse gamma correction section for performing a reverse gamma correction on an input image provided from the image memory after a lapse of the time period, and a display data output section for obtaining the display data on the basis of the input image subjected to the reverse gamma correction by the display reverse gamma correction section and the emission luminance data obtained by the emission luminance calculation section.

In a ninth aspect of the present invention, based on the eighth aspect of the invention, the emission luminance calculation section further includes an emission luminance reverse gamma correction section for performing the reverse gamma correction on the input image provided from outside the device, and the output value calculation section calculates the emission luminance data by performing predetermined computation on tones of a plurality of pixels included in the input image subjected to the reverse gamma correction by the emission luminance reverse gamma correction section.

In a tenth aspect of the present invention, based on the ninth aspect of the invention, the emission luminance reverse gamma correction section performs a correction with reference to a first table indicating a correspondence between the tones of the pixels included in the input image and tones of pixels to be obtained by the reverse gamma correction, and the luminance correction section performs a correction with reference to a second table indicating a correspondence between the tones of the pixels included in the input image and tones of pixels to be obtained by performing a correction for increasing the values within said range of the emission luminance data.

In an eleventh aspect of the present invention, based on the eighth aspect of the invention, the luminance correction section simultaneously subjects the input image provided from outside the device to the reverse gamma correction and the correction for increasing the values within said range of the emission luminance data, and the output value calculation section outputs the emission luminance data calculated by performing predetermined computation on tones of a plurality of pixels included in the input image corrected by the luminance correction section.

In a twelfth aspect of the present invention, based on the eleventh aspect of the invention, the luminance correction section performs a correction with reference to a single table indicating a correspondence between the tones of the pixels included in the input image and tones of pixels to be obtained by performing the reverse gamma correction and the correction for increasing the values within said range of the emission luminance data.

In a thirteenth aspect of the present invention, based on the first aspect of the invention, the backlight includes the light source in plurality, and the emission luminance calculation section divides the input image into a plurality of areas and obtains emission luminance data that indicates luminances upon emission of the light sources corresponding to the areas, on the basis of the input image.

A fourteenth aspect of the present invention is directed to a method for controlling an image display device having a function of controlling a backlight luminance and provided with a backlight including a light source, and a display panel including a plurality of display elements for transmitting light from the light source therethrough in order to display a plurality of pixels, the method comprising:

an emission luminance calculation step of obtaining emission luminance data indicating a luminance upon emission of the light source, on the basis of an input image including a plurality of pixels to be displayed with predetermined tones;

a display data calculation step of obtaining display data in accordance with light transmittances of the display elements, on the basis of the input image and the emission luminance data obtained by the emission luminance calculation step;

a panel drive step of outputting signals for controlling the light transmittances of the display elements to the display panel, on the basis of the display data; and a backlight drive step of outputting signals for controlling the luminance of the light source to the backlight, on the basis of the emission luminance data, wherein, the emission luminance calculation step includes:

an output value calculation step of performing predetermined computation on the tones of the pixels included in the input image, thereby calculating the emission luminance data corresponding to the pixels, and a luminance correction step of correcting the input image for the output value calculation step or the emission luminance data calculated by the output value calculation step, such that values within a predetermined range of the emission luminance data for the display data calculation step are increased.

According to the first aspect of the present invention, the luminance correction section corrects the input image to be provided to the output value calculation section or the emission luminance data calculated by the output value calculation section, such that the values within the predetermined range of the emission luminance data to be provided to the display data calculation section are increased, and therefore, for example, even if the mean luminance of the input image is low, it is possible to prevent a reduction of display quality due to a low backlight luminance, as long as within the predetermined range.

According to the second aspect of the present invention, the luminance correction section adds the predetermined increment to the values within the range from the intermediate value to near the maximum value of the emission luminance data, and therefore, as long as within this range, it is possible to enhance contrast ratio even if the backlight luminance is low (typically, when the mean luminance of the input image is low), and also possible to prevent a tone jump (insufficient luminance) due to an insufficient backlight luminance, thereby preventing a reduction in display quality.

According to the third aspect of the present invention, the increment added by the luminance correction section is minimized at the intermediate value, which is a value greater than or equal to the median of the emission luminance data, and also minimized near the maximum value. Thus, it is possible to appropriately prevent a tone jump at high tone levels.

According to the fourth aspect of the present invention, the luminance correction section adds the predetermined increment to the values within the range from near the minimum value to the intermediate value of the emission luminance data, resulting in a reduction of an error between an actual luminance and a calculated luminance, which increases as the backlight luminance decreases, making it possible to inhibit the error from affecting display, thereby preventing a reduction in display quality.

According to the fifth aspect of the present invention, the increment added by the luminance correction section is maximized near the minimum value of the emission luminance data and minimized at the intermediate value, and therefore the error can be effectively inhibited from resulting in an adverse effect, which increases as the backlight luminance decreases, thereby preventing a reduction in display quality.

According to the sixth aspect of the present invention, the luminance correction section has the features of both the second and fourth aspects of the present invention, and therefore can achieve the same effects as both of the effects achieved by the second and fourth aspects of the invention.

According to the seventh aspect of the present invention, the luminance correction section has the features of both the third and fifth aspects of the present invention, and therefore can achieve the same effects as both of the effects achieved by the third and fifth aspects of the invention.

According to the eighth aspect of the present invention, the emission luminance calculation section performs the reverse gamma correction on the input image provided from outside the device, and on the other hand, in the display data calculation section, the image memory holds the input image for the predetermined time period, and thereafter the display reverse gamma correction section performs the reverse gamma correction on the input image provided from the image memory. The image memory used in this configuration stores input images not subjected to the reverse gamma correction, because emission luminance calculation (e.g., in area-active control) is time-consuming. Thus, the size of memory can be reduced in the image memory, resulting in a scaled-down memory circuit. Moreover, the reverse gamma correction performed by the emission luminance calculation section is more simplified than the reverse gamma correction by the display reverse gamma correction section (to obtain display data), so that the amount of computation therefor, the circuit scale for such computation, etc., can be reduced.

According to the ninth aspect of the present invention, besides the reverse gamma correction by the display reverse gamma correction section, the reverse gamma correction by the emission luminance reverse gamma correction section is performed, and in addition to this, another correction is separately performed to increase the values within the predetermined range of the emission luminance data, so that computation can be performed properly in accordance with the content of one correction separately from another.

According to the tenth aspect of the present invention, the emission luminance reverse gamma correction section references the first table (indicating a correspondence between input and output tones), and further, the luminance correction section references the second table, so that computation for each of the corrections can be performed at high speed with a simplified configuration.

According to the eleventh aspect of the present invention, the luminance correction section simultaneously (collectively) subjects the input image to the reverse gamma correction and the correction for increasing the values within the predetermined range of the emission luminance data, eliminating the need for the emission luminance calculation section to perform separate reverse gamma corrections, so that the amount of computation therefor, the circuit scale for such computation, etc., can be reduced.

According to the twelfth aspect of the present invention, the luminance correction section references a single table (indicating a correspondence between input and output tones), so that computation for a correction can be performed at high speed with a simplified configuration.

According to the thirteenth aspect of the present invention, the same effect as the effect achieved by the first aspect of the invention can be achieved by an area-active image display device.

According to the fourteenth aspect of the present invention, the same effect as the effect achieved by the first aspect of the invention can be achieved by the image display device control method.

DETAILED DESCRIPTION OF THE INVENTION

Hereinafter, embodiments of the present invention will be described with reference to the accompanying drawings.

1. First Embodiment

<1. Overall Configuration and Overview of the Operation>

Figure 1:
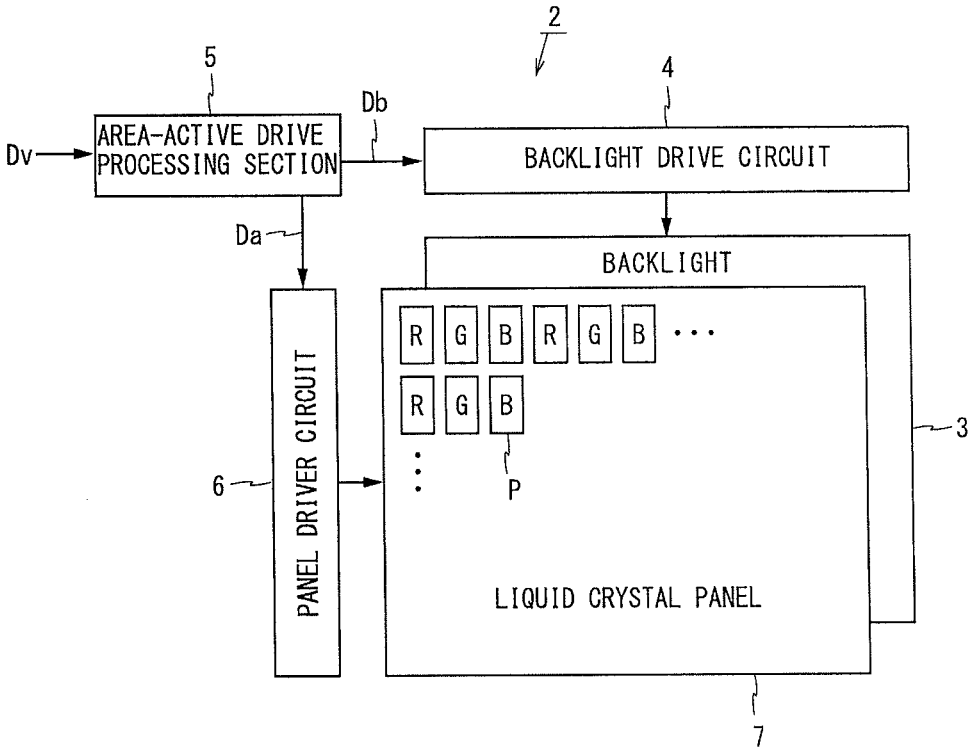
FIG. 1 is a block diagram illustrating the configuration of a liquid crystal display device according to a first embodiment of the present invention.

FIG. 1 is a block diagram illustrating the configuration of a liquid crystal display device 2 according to a first embodiment of the present invention. The liquid crystal display device 2 shown in FIG. 1 includes a backlight 3, a backlight driver circuit 4, a panel driver circuit 6, a liquid crystal panel 7, and an area-active drive processing section 5. The liquid crystal display device 2 performs area-active drive in which the liquid crystal panel 7 is driven with luminances of backlight sources being controlled on the basis of input image portions within a plurality of areas defined by dividing the screen. In the following, m and n are integers of 2 or more, i and j are integers of 1 or more, but at least one of i and j is an integer of 2 or more.

The liquid crystal display device 2 receives a signal which indicates an input image Dv including an R image, a G image, and a B image (hereinafter, the signal will also be simply referred to as the input image Dv). Each of the R, G, and B images includes luminance data for (m×n) pixels. On the basis of the input image Dv, the area-active drive processing section 5 obtains display data (hereinafter, referred to as "liquid crystal data Da") for use in driving the liquid crystal panel 7 and backlight control data (hereinafter, referred to as "LED data Db") for use in driving the backlight 3 (details will be described later).

Here, the liquid crystal display device 2 is a television device, and specifically, the input image Dv is generated by an unillustrated television set (television controller) based on an externally provided color television signal (video signal). In this case, the television set generates the input image Dv by performing a gamma correction individually on each of the R, G, and B images so that a gamma correction curve suitable for the liquid crystal panel 7 can be obtained for the video signal. However, for convenience of explanation, $\gamma=2.2$, which is considered to be an ideal gamma value for color television signals in Japan, is assumed to be used without modification as a preferable gamma value for the liquid crystal panel 7. Thus, the gamma value for the input image Dv (and also for the liquid crystal data Da) is 2.2 here.

The liquid crystal panel 7 includes (m×n×3) display elements P. The display elements P are arranged two-dimensionally as a whole, with each row including 3m of them in its direction (in FIG. 1, horizontally) and each column including n of them in its direction (in FIG. 1, vertically). The display elements P include R, G, and B display elements respectively transmitting red, green, and blue light therethrough. Each set of three display elements, i.e., R, G, and B, arranged in the row direction forms a single pixel.

Note that the liquid crystal panel 7 has a number of display elements P, which include a liquid crystal, but shutter elements made of a well-known substance with electro-optical properties allowing the transmittance of light from the backlight 3 to be controlled may be used in place of the liquid crystal.

The panel driver circuit 6 is a circuit for driving the liquid crystal panel 7. On the basis of the liquid crystal data Da outputted by the area-active drive processing section 5, the panel driver circuit 6 outputs signals (voltage signals) to the liquid crystal panel 7 to control light transmittances of the display elements P. The voltages outputted by the panel driver circuit 6 are written to pixel electrodes (not shown) in the display elements P, and the light transmittances of the display elements P change in accordance with the voltages written to the pixel electrodes.

Figure 2:
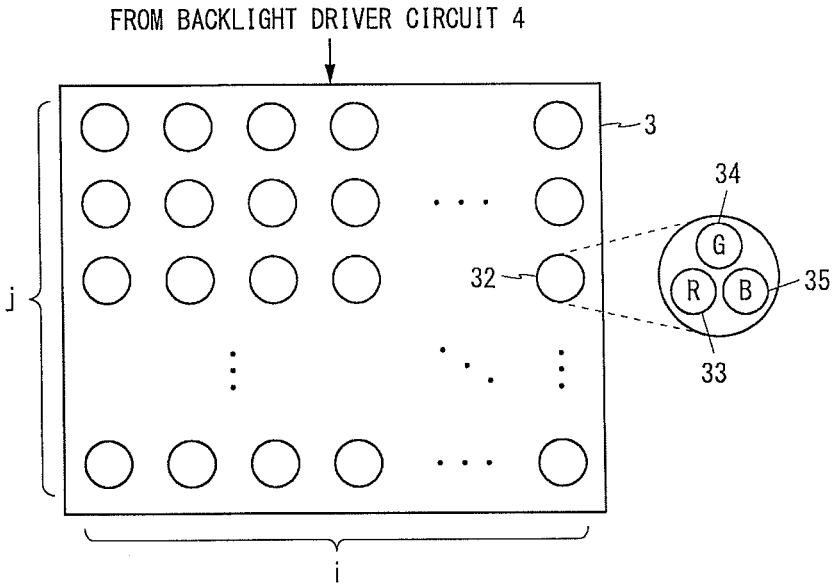
FIG. 2 is a diagram illustrating details of a backlight shown in FIG. 1.

The backlight 3 is provided at the back side of the liquid crystal panel 7 to irradiate backlight to the back of the liquid crystal panel 7. FIG. 2 is a diagram illustrating details of the backlight 3. The backlight 3 includes (i×j) LED units 32, as shown in FIG. 2. The LED units 32 are arranged two-dimensionally as a whole, with each row including i of them in its direction and each column including j of them in its direction. Each of the LED units 32 includes one red LED 33, one green LED 34, and one blue LED 35. The three LEDs 33 to 35 included in each LED unit 32 emit light to be incident on a part of the back of the liquid crystal panel 7.

Note that the LED units 32 may be sets of LEDs emitting colors other than R, G, and B, or may be white LEDs where the luminance does not vary between colors. In addition, the backlight 3 preferably includes LEDs whose luminance can be adjusted at high speed, but other well-known light sources, e.g., CCFLs (cold cathode fluorescent lamps), may be used.

The backlight driver circuit 4 is a circuit for driving the backlight 3. On the basis of the LED data Db outputted by the area-active drive processing section 5, the backlight driver circuit 4 outputs signals (voltage signals or current signals) to the backlight 3 to control luminances of the LEDs 33 to 35. The luminances of the LEDs 33 to 35 are controlled independently of luminances of LEDs inside and outside their units.

The screen of the liquid crystal display device 2 is divided into (i×j) areas, each corresponding to one LED unit 32. Note that, in another configuration, each area may correspond to two or more LED units 32. For each of the (i×j) areas, the area-active drive processing section 5 obtains the luminance of the red LEDs 33 that correspond to that area on the basis of an R image within the area. Similarly, the luminance of the green LEDs 34 is determined on the basis of a G image within the area, and the luminance of the blue LEDs 35 is determined on the basis of a B image within the area. The area-active drive processing section 5 obtains luminances for all LEDs 33 to 35 included in the backlight 3, and outputs LED data Db representing the obtained LED luminances to the backlight driver circuit 4.

Furthermore, on the basis of the LED data Db, the area-active drive processing section 5 obtains backlight luminances for all display elements P included in the liquid crystal panel 7. In addition, on the basis of an input image Dv and the backlight luminances, the area-active drive processing section 5 obtains light transmittances of all of the display elements P included in the liquid crystal panel 7, and outputs liquid crystal data Da representing the obtained light transmittances to the panel driver circuit 6. Note that the method for the area-active drive processing section 5 to obtain the backlight luminances will be described in detail later.

In the liquid crystal display device 2, the luminance of each R display element is the product of the luminance of red light emitted by the backlight 3 and the light transmittance of that R display element. Light emitted by one red LED 33 is incident on a plurality of areas around one corresponding area. Accordingly, the luminance of each R display element is the product of the total luminance of light emitted by a plurality of red LEDs 33 and the light transmittance of that R display element. Similarly, the luminance of each G display element is the product of the total luminance of light emitted by a plurality of green LEDs 34 and the light transmittance of that G display element, and the luminance of each B display element is the product of the total luminance of light emitted by a plurality of blue LEDs 35 and the light transmittance of that B display element.

In the liquid crystal display device 2 thus configured, the liquid crystal data Da and the LED data Db are appropriately obtained on the basis of the input image Dv, the light transmittances of the display elements P are controlled on the basis of the liquid crystal data Da, and the luminances of the LEDs 33 to 35 are controlled on the basis of the LED data Db, so that the input image Dv can be displayed on the liquid crystal panel 7. In addition, when luminances of pixels within an area are low, luminances of LEDs 33 to 35 corresponding to that area are kept low, thereby reducing power consumption by the backlight 3. Moreover, when luminances of pixels within an area are low, luminances of display elements P corresponding to that area are switched among a smaller number of levels, making it possible to enhance image resolution and thereby to improve display image quality.

<1.2 Configuration of the Area-Active Drive Processing Section>

Figure 3:
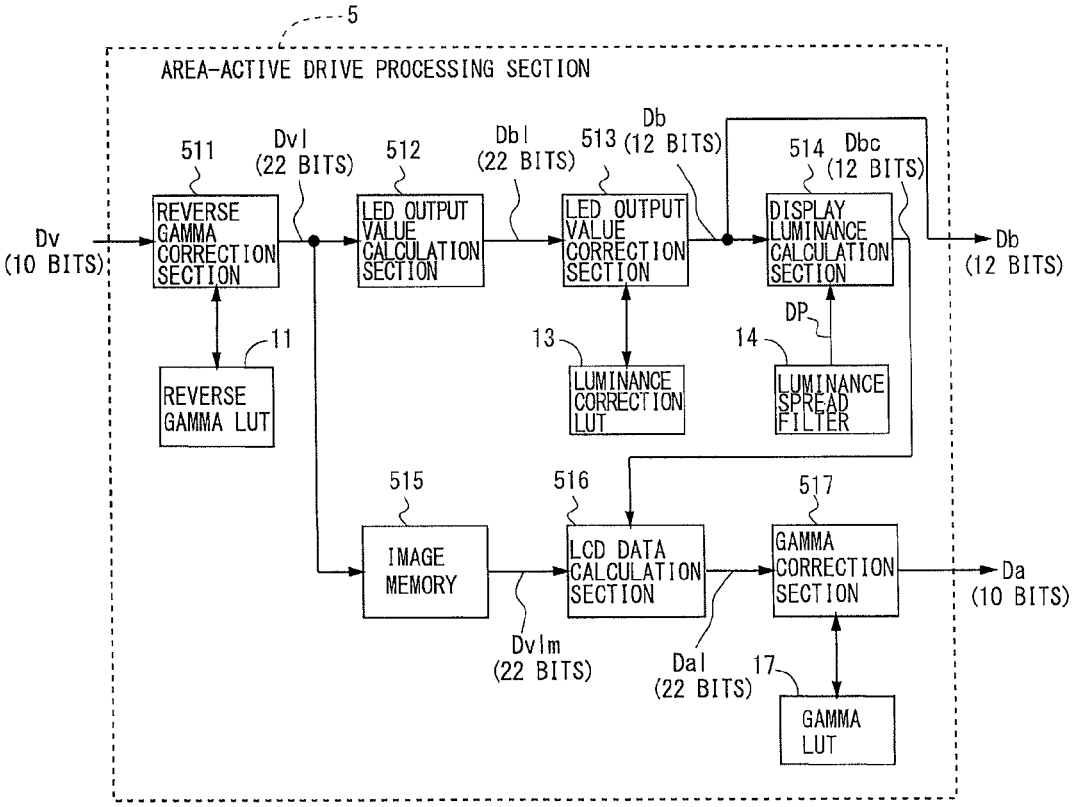
FIG. 3 is a block diagram illustrating a detailed configuration of an area-active drive processing section in the embodiment.
Figures 4, 5:
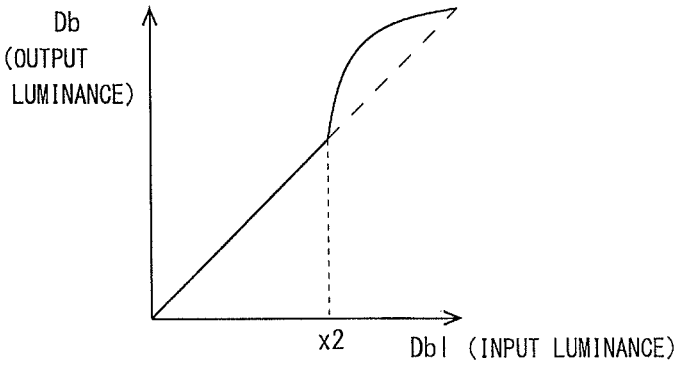
FIG. 4 is a graph describing a luminance correction LUT.
FIG. 5 is a diagram describing a luminance spread filter.

FIG. 3 is a block diagram illustrating a detailed configuration of the area-active drive processing section 5 in the present embodiment. The area-active drive processing section 5 includes a reverse gamma correction section 511, an LED output value calculation section 512, an LED output value correction section 513, a display luminance calculation section 514, image memory 515, an LCD data calculation section 516, and a gamma correction section 517 as components for performing predetermined processing, and also includes a reverse gamma lookup table (hereinafter, abbreviated as a "reverse gamma LUT") 11, a luminance correction lookup table (hereinafter, abbreviated as a "luminance correction LUT") 13 having characteristics as shown in FIG. 4, a luminance spread filter 14 having characteristics as shown in FIG. 5, and a gamma lookup table (hereinafter, abbreviated as a "gamma LUT") 17 as components for storing predetermined data to be described later. Note that the LED output value calculation section 512 also includes components for storing predetermined data. Specifically, these components correspond to predetermined storage devices such as EPROM.

The reverse gamma correction section 511 performs a reverse gamma correction on the input image Dv (with $\gamma=2.2$, as described earlier), and thereby outputs an input image Dvl having linear characteristics (i.e., $\gamma=1$), which are the same as before the gamma correction. Here, the input image Dv is data with ten bits for each of R, G, and B, which is converted (restored) to linear characteristics, resulting in the input image Dvl, which is therefore data with 22 bits for each of R, G, and B. The reverse gamma correction section 511 performs the conversion at high speed with reference to the reverse gamma LUT 11 in which luminance values for the pre-correction input image Dv are correlated with luminance values for the post-correction input image Dvl. Note that the conversion may be performed using a predetermined mathematical expression or suchlike without referring to the LUT.

The LED output value calculation section 512 divides the input image Dvl into a plurality of areas, as will be described below, and obtains LED data (emission luminance data) Dbl (with linear characteristics), which indicates luminances upon emission of LEDs corresponding to the areas. The LED data Dbl is also data with 22 bits for each of R, G, and B. Note that in the following, values for luminances upon emission of LEDs will be referred to as "LED output values".

The LED output value correction section 513 corrects the LED data Dbl obtained by the LED output value calculation section 512, such that the luminance increases as it shifts from an intermediate value (here, the value is between the minimum value and the maximum value but differs from the median) toward around the maximum value, and the result is outputted as LED data Db. Here, the luminance values for the LEDs 33 to 35 can be set at 4096 levels, and therefore the LED data Db is data with 12 bits for each of R, G, and B.

The LED output value correction section 513 performs the conversion at high speed with reference to the luminance correction LUT 13 in which luminance values for the pre-correction LED data Dbl are correlated with luminance values for the post-correction LED data Db. Note that the conversion may be performed using a predetermined mathematical expression or suchlike without referring to the LUT. The characteristics of the luminance correction LUT 13 will be described with reference to FIG. 4.

FIG. 4 is a graph illustrating the characteristics of the luminance correction LUT 13. In FIG. 4, the correspondence is shown between the luminance value of the pre-correction LED data Dbl, which is the input luminance on the horizontal axis, and the luminance value of the post-correction LED data Db, which is the output luminance on the vertical axis. Note that the concrete value for x2 is appropriately determined in accordance with characteristics, etc., of the liquid crystal panel, and here, it is 62.5% of the maximum value.

As can be appreciated with reference to FIG. 4, the luminance value of the pre-correction LED data Dbl (input luminance) in the range from the minimum value to x2 is directly proportional to the luminance value of the corresponding post-correction LED data Db (output luminance). For example, when the luminance value of the LED data Dbl is x2, the luminance value of the LED data Db is 62.5% of the maximum value as well. However, when the luminance value of the pre-correction LED data Dbl is in the range from x2 to the maximum value, it is not directly proportional to the luminance value of the corresponding post-correction LED data Db, but is shifted to a higher degree than in the case where it has such a directly proportional relationship (in the case indicated by a broken line in the figure). Specifically, the increase in the (shifted) luminance from the directly proportional value changes from 0 where the luminance value of the LED data Dbl is x2, gradually increasing in the area from near the median of x2 and the maximum value, and then gradually falls in the area from near the median to the maximum value.

In this manner, when the luminance value of the pre-correction LED data Dbl is from the intermediate value to near the maximum value, the luminance value of the corresponding post-correction LED data Db is corrected to shift to a higher degree. Such a shift correction by the LED output value correction section 513 acts to maintain the depth of display (a satisfactorily darkened display state) in the area from the intermediate value to near the minimum value, and allows peak brightness to be perceived high in the area from the intermediate value to near the maximum value, thereby enhancing contrast ratio. Moreover, the backlight luminance increases in the area from the intermediate value to near the maximum value, resulting in an effect of preventing a tone jump (insufficient luminance) at high tone levels due to an insufficient backlight luminance.

Note that, here, the intermediate value is a value 12.5% greater than the value of the median, which is 50% of the maximum value, but it may be a value between near the maximum value and near the minimum value, so long as the aforementioned effects can be achieved.

However, the intermediate value is preferably in a range such that the depth of display can be maintained in the area from the intermediate value to near the minimum value, and therefore is preferably greater than or equal to 50% of the maximum value, which is the median. Moreover, a tone jump at high tone levels occurs when the backlight luminance around a certain area is low or the backlight is not lit up in its surrounding portions, so that the backlight luminance is insufficient in the certain area. Specifically, pixels in the certain area can be correctly displayed to the maximum tone level when the backlight is completely lit up (with approximately the maximum luminance) in the certain area and its surrounding portions. However, for example, when the backlight is not lit up in the surrounding portions, the backlight luminance is insufficient to display the pixels in the certain area with the maximum tone level, even if the backlight is lit up with the maximum luminance in the certain area (and the transmittance of its corresponding liquid crystal portion is set to the maximum). As a result, a tone jump occurs in a high-tone range of the display pixels in the certain area. Accordingly, to prevent this, the shift correction is preferably performed such that luminance values in the high-tone range that are below the maximum output luminance value approximate to that maximum value, i.e., the luminance value of the post-correction LED data Db, which is the output luminance, in a high-tone range corresponding to the luminance value of the pre-correction LED data Dbl, which is the input luminance, approximately at maximum is increased to as high as the luminance value near the maximum luminance, as shown in FIG. 4. Therefore, preferably, the increase in the luminance value of the post-correction LED data Db is significant near the median of the intermediate value and the maximum value, decreases as the luminance value of the post-correction LED data Db approximates to the maximum value, and is minimized at the intermediate value and the maximum value.

The LED data Db obtained by the LED output value calculation section 512 as described above is provided to the backlight driver circuit 4 and also to the display luminance calculation section 514. Moreover, the luminance spread filter 14 to be referenced by the display luminance calculation section 514 has, for example, PSF data Dp stored therein, as shown in FIG. 5, and the PSF data Dp is data representing diffusion states of light by numerical values to calculate a display luminance for each area. The display luminance calculation section 514 calculates a display luminance Dbc for each area on the basis of the LED data Db along with the PSF data Dp stored in the luminance spread filter 14.

The image memory 515 stores input images Dvl, each being composed of 22 bits for each of R, G, and B, for a predetermined number of frames, and outputs them as input images Dvlm in order from earlier storage with delays of a predetermined number of frames therebetween. By such delays of a predetermined number of frames, they can be provided to the LCD data calculation section 516 in synchronized timing with (in correct correspondence with), particularly, the display luminances Dbc outputted by the display luminance calculation section 514 with delays for their respective areas (due to time-consuming calculations).

On the basis of the input image Dvlm outputted by the image memory 515, and the display luminance Dbc obtained for each area by the display luminance calculation section 514, the LCD data calculation section 516 obtains liquid crystal data Dal with linear characteristics that correspond to the liquid crystal data Da representing the light transmittances of all display elements P included in the liquid crystal panel 7. The calculation method will be described later.

The gamma correction section 517 performs a gamma correction on the liquid crystal data Dal obtained by the LCD data calculation section 516, which is data with linear characteristics (i.e., $\gamma=1$) and 22 bits for each of R, G, and B, such that the data fits with the characteristics of the liquid crystal panel, and outputs liquid crystal data Da (here, $\gamma=2.2$, as mentioned earlier) with 10 bits for each of R, G, and B. The gamma correction is performed at high speed with reference to the gamma LUT 17 in which tone values for the pre-correction liquid crystal data Dal are correlated with tone values for the post-correction liquid crystal data Da. Note that the gamma correction section 517 may perform conversion using a predetermined mathematical expression or suchlike without referencing the LUT.

The area-active drive processing section 5 calculates and outputs the liquid crystal data Da and the LED data Db, as described above, and this processing procedure will be described in further detail below with reference to FIG. 6.

<1.3 Procedure of Processing by the Area-Active Drive Processing Section>

Figure 6:
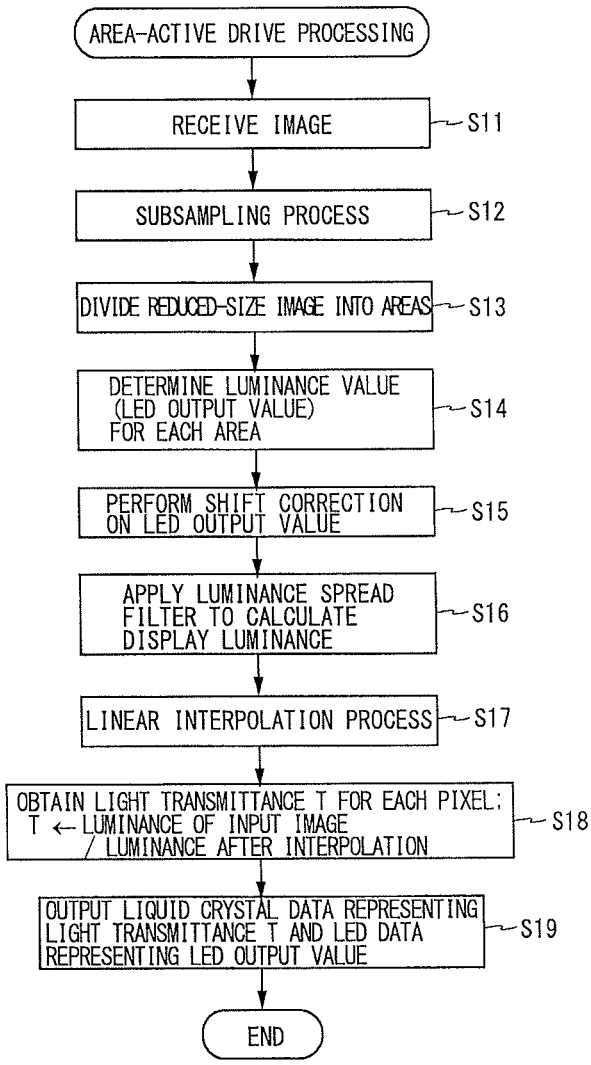
FIG. 6 is a flowchart showing a process by the area-active drive processing section in the embodiment.

FIG. 6 is a flowchart showing a process by the area-active drive processing section 5. The area-active drive processing section 5 (the LED output value calculation section 512 provided therein) receives an image for a color component (hereinafter, referred to as color component C) included in the input image Dvl subjected to a reverse gamma correction (step S11). The received image for color component C includes luminances for (m×n) pixels.

Next, the area-active drive processing section 5 performs a subsampling process (averaging process) on the received image for color component C, and obtains a reduced-size image including luminances for $(s_i \times s_j)$ (where s is an integer of 2 or more) pixels (step S12). In step S12, the received image for color component C is reduced to $s_i/m$ in the horizontal direction and $s_j/n$ in the vertical direction. Then, the area-active drive processing section 5 divides the reduced-size image into (i×j) areas (step S13). Each area includes luminances for (s×s) pixels.

Next, the area-active drive processing section 5 obtains an LED output value (a luminance value upon LED emission) for each of the (i×j) areas (step S14). Conventionally known methods for determining the LED output value include, for example, a method in which a determination is made on the basis of a maximum luminance value Ma among pixels in the area, a method in which a determination is made on the basis of a mean luminance value Me among the pixels in the area, and a method in which a determination is made on the basis of a value obtained by weighted averaging of the maximum luminance value Ma and the mean luminance value Me among the pixels in the area. Note that the processing from steps S11 to S14 is performed by the LED output value calculation section 512 within the area-active drive processing section 5.

Subsequently, with reference to the aforementioned luminance correction LUT 13, the area-active drive processing section 5 corrects the LED output value obtained for each of the (i×j) areas, such that the luminance value in the range from the intermediate value to near the maximum value shifts to a higher degree (step S15). Such a characteristic shift correction increases display quality, as described earlier. Note that the processing of step S15 is performed by the LED output value correction section 513 within the area-active drive processing section 5.

Next, the area-active drive processing section 5 applies a luminance spread filter (dot-spread filter) 14 to the (i×j) LED output values obtained in step S15, thereby obtaining first backlight luminance data including ($t_i \times t_j$) (where t is an integer of 2 or more) display luminances (step S16). In step S16, the (i×j) LED output values are increased to t-fold both in the horizontal and the vertical direction, thereby obtaining ($t_i \times t_j$) display luminances. Note that the processing of step S16 is performed by the display luminance calculation section 514 within the area-active drive processing section 5.

Next, the area-active drive processing section 5 performs a linear interpolation process on the first backlight luminance data, thereby obtaining second backlight luminance data including (m×n) display luminances (step S17). In step S17, the first backlight luminance data is increased to ($m/t_i$)-fold in the horizontal direction and ($n/t_j$)-fold in the vertical direction. The second backlight luminance data represents luminances of backlight for color component C which is incident on (m×n) display elements P for color component C where (i×j) LEDs for color component C emit light with the luminances obtained in step S15.

Next, the area-active drive processing section 5 performs comparative calculations, such as division of the luminances of the (m×n) pixels included in the input image for color component C respectively by the (m×n) luminances included in the second backlight luminance data, thereby obtaining light transmittances T of the (m×n) display elements P for color component C (step S18). Note that the processing of steps S17 and S18 is performed by the LCD data calculation section 516 within the area-active drive processing section 5.

Finally, for color component C, the area-active drive processing section 5 outputs liquid crystal data Da representing the (m×n) light transmittances obtained in step S18, and LED data Db representing the (i×j) LED output values obtained in step S15 (step S19). At this time, the liquid crystal data Da is converted to appropriate values by the gamma correction section 517 in conformity with the specifications of the panel driver circuit 6. In addition, the LED data Db is converted to values within appropriate ranges by the LED output value correction section 513, but it may be converted to more appropriate values in conformity with the specifications of the backlight driver circuit 4.

The area-active drive processing section 5 performs the process shown in FIG. 6 on an R image, a G image, and a B image, thereby obtaining liquid crystal data Da representing (m×n×3) light transmittances and LED data Db representing (i×j×3) LED output values, on the basis of an input image Dv including luminances of (m×n×3) pixels.

Figure 7:
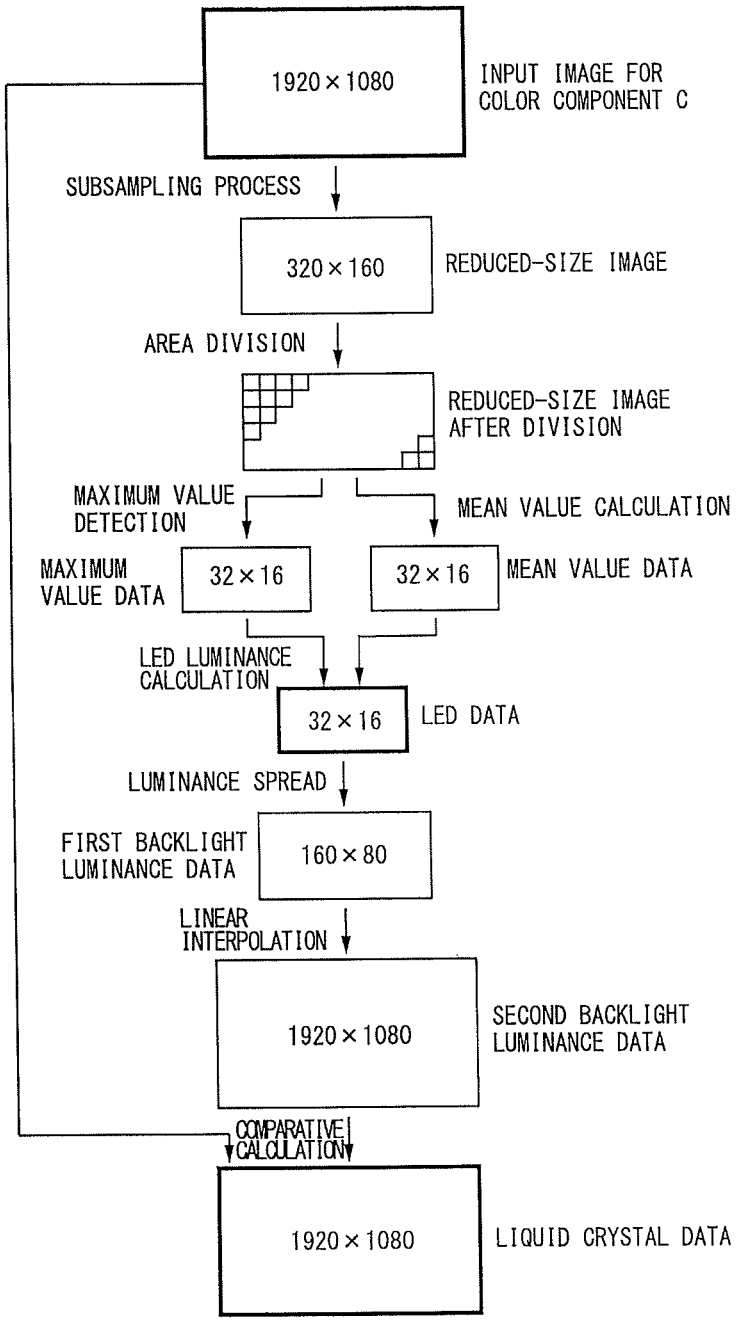
FIG. 7 is a diagram showing the course of action up to obtaining liquid crystal data and LED data in the embodiment.

FIG. 7 is a diagram showing the course of action up to obtaining liquid crystal data and LED data where m=1920, n=1080, i=32, j=16, s=10, and t=5. As shown in FIG. 7, a subsampling process is performed on an input image for color component C, which includes luminances of (1920×1080) pixels, thereby obtaining a reduced-size image including luminances of (320×160) pixels. The reduced-size image is divided into (32×16) areas (the size of each area is (10×10) pixels). For each area, the maximum value Ma and the mean value Me for the pixel luminances are calculated, thereby obtaining maximum value data including (32×16) maximum values and mean value data including (32×16) mean values. Then, LED data for color component C, representing (32×16) LED luminances (LED output values), is obtained on the basis of the maximum value data, the mean value data, or a weighted average of the maximum value data and the mean value data.

By applying the luminance spread filter 14 to the LED data for color component C, first backlight luminance data, including (160×80) display luminances, is obtained. By performing a linear interpolation process on the first backlight luminance data, second backlight luminance data, including (1920×1080) display luminances, is obtained. Finally, liquid crystal data for color component C, including (1920×1080) light transmittances, is obtained by comparative calculations, such as division of the pixel luminances included in the input image by the display luminances included in the second backlight luminance data.

Note that in FIG. 6, for ease of explanation, the area-active drive processing section 5 sequentially performs the process on images for color components, but the process may be performed on the images for color components in a time-division manner. Furthermore, in FIG. 6, the area-active drive processing section 5 performs a subsampling process on an input image for noise removal and performs area-active drive on the basis of a reduced-size image, but the area active drive may be performed on the basis of the original input image.

Furthermore, the size of data such as the input image Dv (e.g., values such as 10 bits for each of R, G, and B) is illustrative and can be arbitrary, and this also applies to the following embodiments. However, for (accurate) conversion (by the reverse gamma correction section 511) to data with linear characteristics, the size of output data (input image Dvl) is typically larger than input data (input image Dv).

<1.4 Effect>

In this manner, the LED output value correction section 513 in the present embodiment corrects the LED data Dbl obtained by the LED output value calculation section 512 with reference to the luminance correction LUT 13, such that the luminance value in the range from the intermediate value to near the maximum value shifts to a higher degree. Thus, even if the backlight luminance is low (typically, the mean luminance of an input image is low), it is possible to allow peak brightness to be perceived high while maintaining the depth of display, thereby enhancing contrast ratio, and it is also possible to prevent a tone jump (insufficient luminance) at high tone levels due to an insufficient backlight luminance, thereby preventing a reduction in display quality.

2. Second Embodiment

<2.1 Overall Configuration and Operation>

The configuration and the operation of a liquid crystal display device 2 according to a second embodiment of the present invention are almost the same as those of the liquid crystal display device 2 according to the first embodiment, except that the luminance correction LUT 13 in the present embodiment has different characteristics from the luminance correction LUT 13 in the first embodiment shown in FIG. 4.

Specifically, the liquid crystal display device 2 according to the second embodiment of the present invention is configured in the same manner as the liquid crystal display device 2 according to the first embodiment shown in FIG. 1, the backlight 3 is also configured in the same manner as in the first embodiment shown in FIG. 2, the configuration of the area-active drive processing section 5 is also the same in detail as in the first embodiment shown in FIG. 3, except for the contents of the luminance correction LUT 13, and the processing procedures are also the same as in the first embodiment shown in FIG. 6, therefore, the same components (and processing procedures) will be denoted by the same characters, and any descriptions thereof will be omitted. Hereinafter, the details of a shift correction operation by the LED output value correction section 513 using the luminance correction LUT 13 in the present embodiment will be described with reference to FIG. 8.

<2.2 Shift Correction Operation of the LED Output Value Correction Section>

Figure 8:
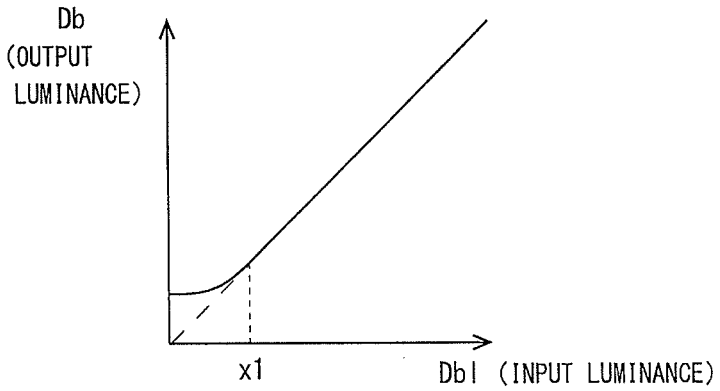
FIG. 8 is a graph describing a luminance correction LUT in a second embodiment of the present invention.

FIG. 8 is a graph illustrating the characteristics of the luminance correction LUT 13 in the present embodiment. In FIG. 8, as in FIG. 4, the correspondence is shown between the luminance value of the pre-correction LED data Dbl, which is the input luminance on the horizontal axis, and the luminance value of the post-correction LED data Db, which is the output luminance on the vertical axis. Note that the concrete value for x1 is appropriately determined in accordance with characteristics, etc., of the liquid crystal panel, and here, it is 25% of the maximum value.

As can be appreciated with reference to FIG. 8, the luminance value of the pre-correction LED data Dbl in the range from x1 to the maximum value is directly proportional to the luminance value of the corresponding post-correction LED data Db. For example, when the luminance value of the LED data Dbl is x1, the luminance value of the LED data Db is 25% of the maximum value. However, when the luminance value of the pre-correction LED data Dbl is in the range from the minimum value to x1, it is not directly proportional to the luminance value of the corresponding post-correction LED data Db, but is shifted to a higher degree than in the case where it has such a directly proportional relationship (in the case indicated by a broken line in the figure). Specifically, the increase in the (shifted) luminance from the directly proportional value is maximum when the luminance value of the LED data Dbl is 0, and gently changes from 0 to x1 while gradually decreasing.

In this manner, the luminance value of the pre-correction LED data Dbl is in the range from near the minimum value to the intermediate value, the luminance value of the corresponding post-correction LED data Db is corrected so as to be shifted to a higher luminance value. Such a shift correction by the LED output value correction section 513 makes it possible to minimize an error between an actual luminance and a calculated luminance, which occurs when the backlight luminance is low, thereby inhibiting the error from affecting display.

Specifically, to determine the backlight luminance for a certain area, the PSF data Dp stored in the luminance spread filter 14 is used, as described earlier with reference to FIG. 5, but the value of the PSF data Dp is an ideal value and constantly deviates from the actual luminance. In addition, weak light often leaks to surrounding areas other than areas (24 areas shown in FIG. 5) to which the PSF data Dp is applied, but is not taken into consideration. In this manner, an error always occurs when calculating the luminance of light from other areas that affects a certain area. In addition, as the backlight luminance in that certain area decreases, the certain area becomes more affected by light from other areas increases, so that the error (to be exact, the proportion of the error in the backlight luminance obtained by calculation) increases. Accordingly, the error increases with the display pixel luminance, and becomes more prone to appear on the display as a component (noise) that prevents display with an ideal luminance, resulting in reduced display quality.

The LED output value correction section 513 in the present embodiment performs the shift correction on the LED output value, as described above, with reference to the luminance correction LUT 13 with the characteristics as shown in FIG. 8. As a result, when the backlight luminance is near the minimum value (which is very low), an increase is maximized up to the intermediate value, thereby producing the action of inhibiting the error from affecting display.

Note that the LED output value correction section 513 may achieve the shift correction by performing conversion using a predetermined mathematical expression or suchlike without referencing the luminance correction LUT 13. In addition, the intermediate value here is a value 25% lower than the median, which is 50% of the maximum value, but it may be a value in the range from near the maximum value to near the minimum value, so long as the effects as mentioned above can be achieved.

However, noise due to the error becomes more prone to appear in display as the backlight luminance decreases, and therefore the intermediate value is preferably a value less than or equal to the median, which is 50% of the maximum value. In addition, for this reason, the increase in the luminance is maximized at the minimum value of the backlight luminance, and is minimized at the intermediate value.

<2.3 Effect>

In this manner, the LED output value correction section 513 in the present embodiment corrects the LED data Dbl obtained by the LED output value calculation section 512 with reference to the luminance correction LUT 13 with the characteristics as shown in FIG. 8, such that the luminance value in the range from near the minimum value to the intermediate value shifts to a higher degree. Thus, it is possible to inhibit the error from resulting in an adverse effect (noise in display), which increases as the backlight luminance decreases (typically, as the mean luminance of an input image decreases), thereby preventing a reduction in display quality.

3. Third Embodiment

<3.1 Overall Configuration and Operation>

The configuration and the operation of a liquid crystal display device 2 according to a third embodiment of the present invention are almost the same as those of the liquid crystal display device 2 according to the first or second embodiment, except that the luminance correction LUT 13 in the present embodiment has different characteristics from the luminance correction LUT 13 in the first or second embodiment shown in FIG. 4 or 8.

Specifically, the liquid crystal display device 2 according to the third embodiment of the present invention, including the backlight 3, is configured in the same manner as the liquid crystal display device 2 according to the first or second embodiment, the configuration of the area-active drive processing section 5 is also the same in detail as in the first embodiment shown in FIG. 3, except for the contents of the luminance correction LUT 13, and the processing procedures are also the same as in the first embodiment shown in FIG. 6, therefore, the same components (and processing procedures) will be denoted by the same characters, and any descriptions thereof will be omitted. Hereinafter, the details of a shift correction operation by the LED output value correction section 513 using the luminance correction LUT 13 in the present embodiment will be described with reference to FIG. 9.

<3.2 Shift Correction Operation by the LED Output Value Correction Section>

Figure 9:
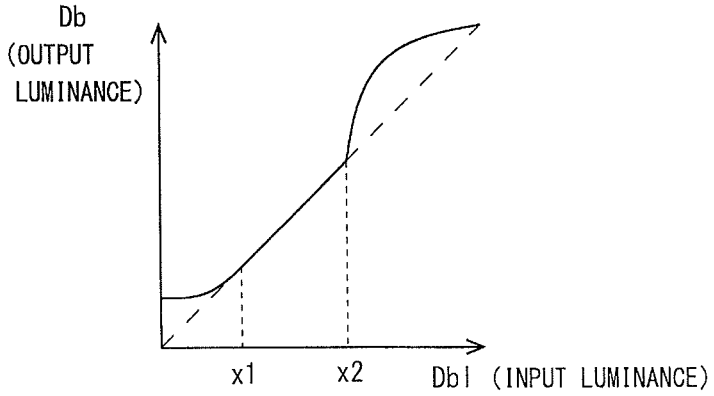
FIG. 9 is a graph describing a luminance correction LUT in a third embodiment of the present invention.

FIG. 9 is a graph illustrating the characteristics of the luminance correction LUT 13 in the present embodiment. In FIG. 9, as in FIGS. 4 and 8, the correspondence is shown between the luminance value of the pre-correction LED data Dbl, which is the input luminance on the horizontal axis, and the luminance value of the post-correction LED data Db, which is the output luminance on the vertical axis. Note that the concrete values for x1 and x2 are the same as set forth above.

As can be appreciated with reference to FIG. 9 in comparison with FIGS. 4 and 8, the luminance correction LUT 13 shown in FIG. 9 is characterized by including both a distinguishing feature (related to the shift correction) of the characteristics of the luminance correction LUT 13 shown in FIG. 4 and a distinguishing feature (related to the shift correction) of the characteristics of the luminance correction LUT 13 shown in FIG. 8.

Specifically, the luminance value of the pre-correction LED data Dbl in the range from x1 to x2 is directly proportional to the luminance value of the corresponding post-correction LED data Db. However, when the luminance value of the pre-correction LED data Dbl is in the range from the minimum value to x1 and in the range from x2 to the maximum value, it is not directly proportional to the luminance value of the corresponding post-correction LED data Db, but is shifted to a higher degree than in the case where it has such a directly proportional relationship (in the case indicated by a broken line in the figure). With such a shift correction operation, the same actions as in the first and second embodiments can occur at the same time. Note that the LED output value correction section 513 may achieve the shift correction by performing conversion using a predetermined mathematical expression or suchlike without referencing the luminance correction LUT 13. Moreover, the intermediate values taking x1 and x2, the aforementioned increases in values, the behavior of changes in values, etc., are the same as described in the first and second embodiments.

<3.3 Effect>

In this manner, the LED output value correction section 513 in the present embodiment corrects the LED data Dbl obtained by the LED output value calculation section 512 with reference to the luminance correction LUT 13 with the characteristics as shown in FIG. 9, such that the luminance shifts to a higher degree in the range from near the minimum value to the intermediate value and also in the range from the intermediate value to near the maximum value. Thus, as in the first embodiment, even if the backlight luminance is low, it is possible to allow peak brightness to be perceived high while maintaining the depth of display, thereby enhancing contrast ratio, and further, as in the second embodiment, it is possible to prevent a tone jump (insufficient luminance) at high tone levels due to an insufficient backlight luminance, and also to inhibit the error from resulting in an adverse effect (noise in display), which increases as the backlight luminance decreases, thereby preventing a reduction in display quality.

4. Fourth Embodiment

<4.1 Overall Configuration and Operation>

The configuration, the operation, etc., of a liquid crystal display device 2 according to a fourth embodiment of the present invention are almost the same as those of the liquid crystal display device 2 according to the first embodiment shown in FIGS. 1, 2, and 6, therefore, the same components (and processing procedures) will be denoted by the same characters, and any descriptions thereof will be omitted.

In the present embodiment, the configuration of the area-active drive processing section 5 differs in detail from that in the first embodiment shown in FIG. 3. Concretely, in the present embodiment, each of the reverse gamma correction section 511 and the reverse gamma LUT 11 shown in FIG. 3 has two functions respectively for LED and LCD, and the contents of data stored in the image memory are also different. Hereinafter, referring to FIG. 10, the configuration and the operation of the area-active drive processing section in the present embodiment will be described in detail.

<4.2 Configuration of the Area-Active Drive Processing Section>

Figure 10:
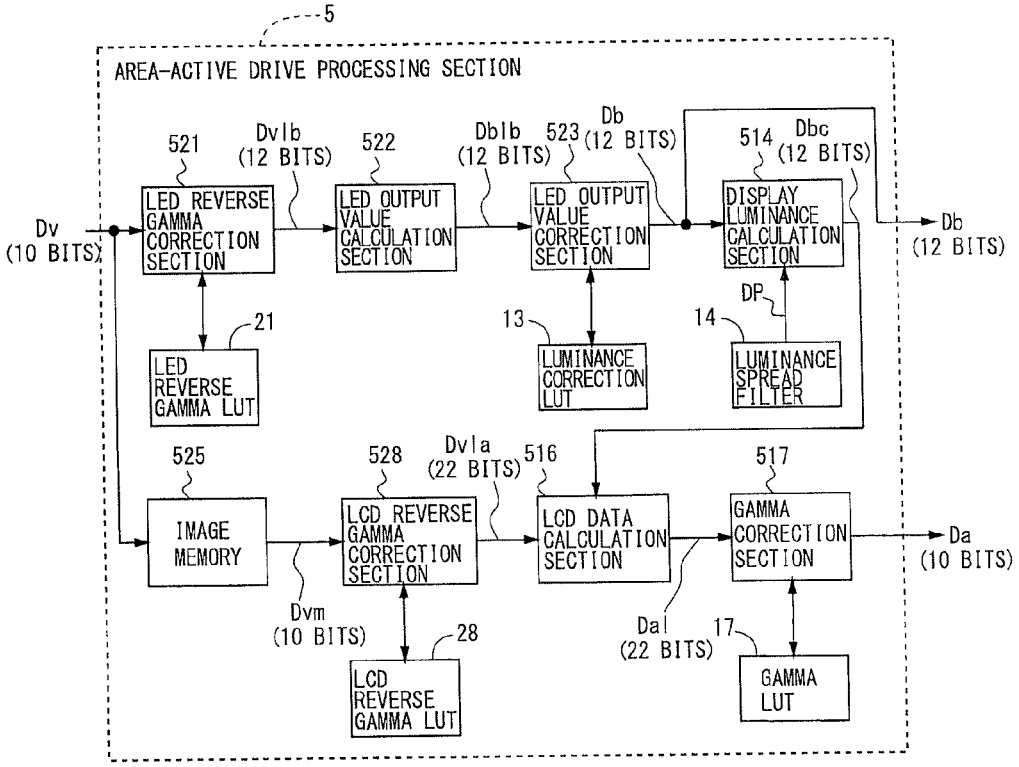
FIG. 10 is a block diagram illustrating a detailed configuration of an area-active drive processing section in a fourth embodiment of the present invention.

FIG. 10 is a block diagram illustrating a detailed configuration of the area-active drive processing section 5 in the present embodiment. The area-active drive processing section 5 includes an LED reverse gamma correction section 521, an LCD reverse gamma correction section 528, an LED output value calculation section 522, an LED output value correction section 523, and image memory 525, along with the same display luminance calculation section 514, LCD data calculation section 516, and gamma correction section 517 as in the first embodiment, as components for performing predetermined processing, and also includes an LED reverse gamma LUT 21 and an LCD reverse gamma LUT 28, along with the same luminance correction LUT 13 (having characteristics as shown in FIG. 4), luminance spread filter 14, and gamma LUT 17 as in the first embodiment, as components for storing predetermined data.

Similar to the reverse gamma correction section 511 in the first embodiment, the LED reverse gamma correction section 521 and the LCD reverse gamma correction section 528 perform a reverse gamma correction on an input image Dv or an input image Dvm (where $\gamma=2.2$) with reference to the LED reverse gamma LUT 21 or the LCD reverse gamma LUT 28, and output input images with the same linear characteristics (i.e., $\gamma=1$) as before the gamma correction.

However, the LED reverse gamma correction section 521 converts (restores) a provided input image Dv with 10 bits for each of R, G, and B to linear characteristics, and outputs an input image Dvlb with 12 bits for each of R, G, and B unlike in the first embodiment (in place of the input image Dvl with 22 bits for each of R, G, and B obtained by such conversion). Here, for the LEDs 33 to 35, luminance values can be set at merely 4096 levels, and the conversion to data with 12 bits for each of R, G, and B suffices because conversion to completely linear characteristics is not required unlike in the case of the liquid crystal data.

Accordingly, the LED output value calculation section 522 simply performs calculation on an input image Dvlb with 12 bits for each of R, G, and B to obtain LED data Dblb with 12 bits for each of R, G, and B (which has linear characteristics), and is not required to perform calculations on the input image Dvl with 22 bits for each of R, G, and B to obtain the LED data Dbl with 22 bits for each of R, G, and B, unlike in the first embodiment, so that the amount of computation for calculating LED output values and the circuit scale for such computation can be reduced.

Note that the LED reverse gamma correction section 521 and the LCD reverse gamma correction section 528 may perform the conversion using a predetermined mathematical expression or suchlike without referencing the LED reverse gamma LUT 21 or the LCD reverse gamma LUT 28.

Furthermore, the LCD reverse gamma correction section 528 has the same function as the reverse gamma correction section 511 in the first embodiment, but differs therefrom in receiving the input image Dvm from the image memory 525 and outputting an input image Dvla to be provided to the LCD data calculation section 516 (i.e., it differs in position).

Next, the image memory 525 differs from the image memory 515 in the first embodiment in storing pre-correction input images (with 10 bits for each of R, G, and B) for a predetermined number of frames, rather than input images Dvl (with 22 bits for each of R, G, and B) subjected to a reverse gamma correction, and outputting input images Dvlm (with 10 bits for each of R, G, and B) with delays of a predetermined number of frames therebetween. The reason that such storage of pre-correction input images is possible is because in the present embodiment, the LED reverse gamma correction section 521 is present independently of the LCD reverse gamma correction section 528, so that there is no need to store input images subjected to a reverse gamma correction. Thus, the configuration of the present embodiment in which the pre-correction input images Dv are stored can significantly reduce the circuit scale of the memory.

Concretely, for the image memory where the number of frames to be delayed for timing synchronization as described earlier is f, and a 1920×1080 pixel image is stored per frame, the image memory 525 in the present embodiment requires a memory size of f×1920×1080×3×12 (bits)), whereas the image memory 515 in the first embodiment requires a memory size of f×1920×1080×3×22 (bits), therefore, the present embodiment requires only about 54.5% (=12/22) of the memory size of the first embodiment, so that the circuit scale of the image memory can be significantly reduced.

Furthermore, the LED output value correction section 523 can use the LED data Dblb with 12 bits for each of R, G, and B obtained by the LED output value calculation section 522, without modification, and it is not necessary to perform calculations on an input image with 22 bits for each of R, G, and B unlike in the first embodiment, so that the amount of computation for correction, the circuit scale for such computation, and the data size of the luminance correction LUT 13 can be reduced. Here, the characteristics of the luminance correction LUT 13 are the same as in the first embodiment described with reference to FIG. 4. Note that the shift correction may be performed using a predetermined mathematical expression or suchlike without referencing the LUT.

<4.3 Effect>

In this manner, the LED output value correction section 523 in the present embodiment corrects the LED data Dblb obtained by the LED output value calculation section 522 with reference to the luminance correction LUT 13 shown in FIG. 4, such that the luminance in the range from the intermediate value to near the maximum value shifts to a higher degree. Thus, as in the first embodiment, even if the backlight luminance is low, it is possible to allow peak brightness to be perceived high while maintaining the depth of display, thereby enhancing contrast ratio, and also to prevent a tone jump (insufficient luminance) at high tone levels due to an insufficient backlight luminance, thereby preventing a reduction in display quality.

Furthermore, the LCD reverse gamma correction section 528 and the LED reverse gamma correction section 521 are provided separately, so that the amount of computation, the circuit scale for such computation, etc., can be reduced in the LED output value calculation section 522 and the LED output value correction section 523, and further, with such a configuration, input images Dv not subjected to a reverse gamma correction can be stored to the image memory 525, so that the size of memory can be reduced, resulting in a scaled-down memory circuit.

5. Fifth Embodiment

The configuration and the operation of a liquid crystal display device 2 according to a fifth embodiment of the present invention are almost the same as those of the liquid crystal display device 2 according to the fourth embodiment, except for the characteristics of the luminance correction LUT 13, therefore, the same components (and processing procedures) will be denoted by the same characters, and any descriptions thereof will be omitted.

Furthermore, unlike in the fourth embodiment, the luminance correction LUT 13 in the present embodiment does not have the same characteristics as the luminance correction LUT 13 in the first embodiment, but has the same characteristics and actions as the luminance correction LUT 13 in the second embodiment shown in FIG. 8.

Accordingly, the LED output value correction section 523 in the present embodiment corrects the LED data Dblb obtained by the LED output value calculation section 522 with reference to the luminance correction LUT 13 shown in FIG. 8, such that the luminance in the range from near the minimum value to the intermediate value shifts to a higher degree. Thus, as in the second embodiment, it is possible to inhibit the error from resulting in an adverse effect (noise in display), which increases as the backlight luminance decreases, thereby preventing a reduction in display quality.

Furthermore, as in the fourth embodiment, the amount of computation, the circuit scale for such computation, etc., can be reduced in the LED output value calculation section 522 and the LED output value correction section 523, and the size of memory can be reduced in the image memory 525, resulting in a scaled-down memory circuit.

6. Sixth Embodiment

The configuration and the operation of a liquid crystal display device 2 according to a sixth embodiment of the present invention are almost the same as those of the liquid crystal display device 2 according to the fourth embodiment, except for the characteristics of the luminance correction LUT 13, therefore, the same components (and processing procedures) will be denoted by the same characters, and any descriptions thereof will be omitted.

Furthermore, unlike in the fourth embodiment, the luminance correction LUT 13 in the present embodiment does not have the same characteristics as the luminance correction LUT 13 in the first embodiment, but has the same characteristics and actions as the luminance correction LUT 13 in the third embodiment shown in FIG. 9.

Accordingly, the LED output value correction section 523 in the present embodiment can enhance contrast ratio with reference to the luminance correction LUT 13 shown in FIG. 9, as in the first embodiment, even if the backlight luminance is low, and also can prevent a tone jump (insufficient luminance) at high tone levels due to an insufficient backlight luminance, and further, as in the second embodiment, it is possible to inhibit the error from resulting in an adverse effect (noise in display), which increases as the backlight luminance decreases, thereby preventing a reduction in display quality.

Furthermore, as in the fourth embodiment, the amount of computation, the circuit scale for such computation, etc., can be reduced in the LED output value calculation section 522 and the LED output value correction section 523, and the size of memory can be reduced in the image memory 525, resulting in a scaled-down memory circuit.

7. Seventh Embodiment

<7.1 Overall Configuration and Operation>

The configuration, the operation, etc., of a liquid crystal display device 2 according to a seventh embodiment of the present invention are almost the same as those of the liquid crystal display devices 2 according to the first and fourth embodiments shown in FIGS. 1, 2, and 6, therefore, the same components (and processing procedures) will be denoted by the same characters, and any descriptions thereof will be omitted.

In the present embodiment, the configuration of the area-active drive processing section 5 differs in detail from that of the fourth embodiment shown in FIG. 10. Specific differences from the fourth embodiment are such that the LED output value correction section 523 and the luminance correction LUT 13 shown in FIG. 10 are omitted in the present embodiment, and their functions are integrated with the functions of the LED reverse gamma correction section 521 and the LED reverse gamma LUT 21, so that a reverse gamma/luminance correction section 531 and a reverse gamma/luminance LUT 31 are provided anew. Hereinafter, with reference to FIG. 11, the configuration and the operation of the area-active drive processing section in the present embodiment will be described in detail.

<7.2 Configuration of the Area-Active Drive Processing Section>

Figure 11:
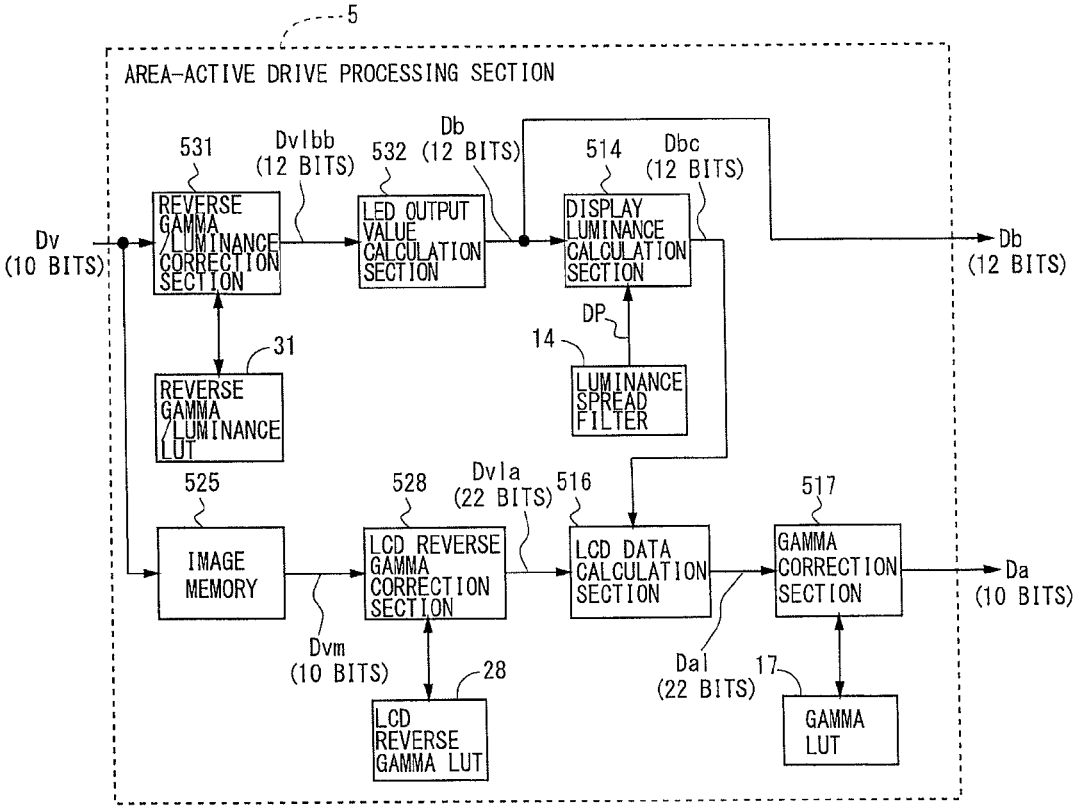
FIG. 11 is a block diagram illustrating a detailed configuration of an area-active drive processing section in a seventh embodiment of the present invention.

FIG. 11 is a block diagram illustrating a detailed configuration of the area-active drive processing section 5 in the present embodiment. The area-active drive processing section 5 includes a reverse gamma/luminance correction section 531 and an LED output value calculation section 532, along with the same display luminance calculation section 514, LCD data calculation section 516, and gamma correction section 517 as in the first embodiment (and the fourth embodiment), as well as the same image memory 525 and LCD reverse gamma correction section 528 as in the fourth embodiment, as components for performing predetermined processing, and also includes a reverse gamma/luminance LUT 31, along with the same LCD reverse gamma LUT 28 as in the fourth embodiment, as well as the same luminance correction LUT 13 (having characteristics as shown in FIG. 4), luminance spread filter 14, and gamma LUT 17 as in the first embodiment (and the fourth embodiment), as components for storing predetermined data.

The reverse gamma/luminance correction section 531 converts (restores) an input image Dv with 10 bits for each of R, G, and B to linear characteristics, as with the LED reverse gamma correction section 521 in the fourth embodiment, while simultaneously performing a shift correction as does the LED output value correction section 523 in the fourth embodiment.

Specifically, as described earlier, the LED reverse gamma correction section 521 in the fourth embodiment performs a reverse gamma correction with reference to the LED reverse gamma LUT 21, and the LED output value correction section 523 in the fourth embodiment performs a shift correction with reference to the luminance correction LUT 13. Therefore, by correcting the input image Dv with reference to the reverse gamma/luminance LUT 31, which is an LUT created by integrating the LED reverse gamma LUT 21 and the luminance correction LUT 13, it is possible to simultaneously (collectively) perform the reverse gamma correction and the shift correction.

Concretely, for the luminance correction LUT 13 shown in FIG. 4, an increase in output luminance for the shift correction is determined on the premise that the LED data Dbl, which is the input luminance, has linear characteristics (on the basis of the broken line shown in FIG. 4). Accordingly, the reverse gamma/luminance LUT 31 can be created by adding the increase for the shift correction to the output luminance in the LED reverse gamma LUT 21 of the fourth embodiment (any detailed description will be omitted because its characteristics themselves are well-known).

With reference to such a reverse gamma/luminance LUT 31, the reverse gamma/luminance correction section 531 performs corrections (i.e., a reverse gamma correction and a shift correction) on the input image Dv, and outputs an input image Dvlbb with 12 bits for each of R, G, and B resulting from the corrections.

The LED output value calculation section 532 receives the input image Dvlbb with 12 bits for each of R, G, and B thus resulting from the corrections, and outputs LED data Db with 12 bits for each of R, G, and B. The content of the operation here is the same as the operation of the LED output value calculation section 512 in the first embodiment, except for the number of bits in the data to be inputted or outputted and whether the corrections are performed or not, and the technique to convert the number of bits in the data is well-known, therefore, any descriptions thereof will be omitted here. Note that the reverse gamma correction and the shift correction may be simultaneously performed using predetermined mathematical expressions or suchlike without referencing the reverse gamma/luminance LUT 31.

<7.3 Effect>

In this manner, the reverse gamma/luminance correction section 531 in the present embodiment outputs the input image Dvlbb subjected to a shift correction with reference to the reverse gamma/luminance LUT 31 with combined characteristics of the luminance correction LUT 13 (in terms of the aforementioned increase) shown in FIG. 4 and the reverse gamma LUT 11 (or the LED reverse gamma LUT 21), such that the luminance in the range from the intermediate value to near the maximum value shifts to a higher degree. Thus, as in the first embodiment, even if the backlight luminance is low, it is possible to enhance contrast ratio, and also to prevent a tone jump (insufficient luminance) at high tone levels due to an insufficient backlight luminance, thereby preventing a reduction in display quality.

Furthermore, unlike in the first through sixth embodiments, the LED output value correction section and the luminance correction LUT can be omitted, so that the amount of computation therefor, the circuit scale for such computation, etc., can be reduced.

Further still, as in the fourth through sixth embodiments, the LCD reverse gamma correction section 528 is provided independently of the reverse gamma/luminance correction section 531, so that the amount of computation, the circuit scale for such computation, etc., can be reduced in the LED output value calculation section 532 (to a greater degree than in the case of the first through third embodiments), and further, such a configuration allows the image memory 525 to store the input image Dv not subjected to a reverse gamma correction, so that the size of memory can be reduced (to a greater degree than in the case of the first through third embodiments), resulting in a scaled-down memory circuit.

8. Eighth Embodiment

The configuration and the operation of a liquid crystal display device 2 according to an eighth embodiment of the present invention are almost the same as those of the liquid crystal display device 2 according to the seventh embodiment, except for the characteristics of the reverse gamma/luminance LUT 31, therefore, the same components (and processing procedures) will be denoted by the same characters, and any descriptions thereof will be omitted.

Furthermore, unlike in the seventh embodiment, the reverse gamma/luminance LUT 31 in the present embodiment does not have combined characteristics of the luminance correction LUT 13 (in terms of the aforementioned increase) in the first embodiment shown in FIG. 4 and the reverse gamma LUT 11 (or the LED reverse gamma LUT 21), but has the same characteristics and actions as the luminance correction LUT 13 (in terms of the aforementioned increase) in the second embodiment shown in FIG. 8 in combination with the reverse gamma LUT 11 (or the LED reverse gamma LUT 21).

Accordingly, the reverse gamma/luminance correction section 531 in the present embodiment outputs the input image Dvlbb subjected to a shift correction with reference to the reverse gamma/luminance LUT 31 with combined characteristics of the luminance correction LUT 13 (in terms of the aforementioned increase) shown in FIG. 8 and the reverse gamma LUT 11 (or the LED reverse gamma LUT 21), such that the luminance in the range from near the minimum value to the intermediate value shifts to a higher degree. Thus, as in the second embodiment, it is possible to inhibit the error from resulting in an adverse effect (noise in display), which increases as the backlight luminance decreases, thereby preventing a reduction in display quality.

Furthermore, as in the seventh embodiment, the LED output value correction section and the luminance correction LUT can be omitted, so that the amount of computation therefor, the circuit scale for such computation, etc., can be reduced, and further, the amount of computation, the circuit scale for such computation, etc., can be reduced in the LED output value calculation section 532, so that the size of memory can be reduced in the image memory 525, resulting in a scaled-down memory circuit.

9. Ninth Embodiment

The configuration and the operation of a liquid crystal display device 2 according to a ninth embodiment of the present invention are almost the same as those of the liquid crystal display device 2 according to the seventh embodiment, except for the characteristics of the reverse gamma/luminance LUT 31, therefore, the same components (and processing procedures) will be denoted by the same characters, and any descriptions thereof will be omitted.

Furthermore, unlike in the seventh embodiment, the reverse gamma/luminance LUT 31 in the present embodiment does not have combined characteristics of the luminance correction LUT 13 (in terms of the aforementioned increase) in the first embodiment shown in FIG. 4 and the reverse gamma LUT 11 (or the LED reverse gamma LUT 21), but has the same characteristics and actions as the luminance correction LUT 13 (in terms of the aforementioned increase) in the third embodiment shown in FIG. 9 in combination with the reverse gamma LUT 11 (or the LED reverse gamma LUT 21).

Accordingly, the reverse gamma/luminance correction section 531 in the present embodiment references the reverse gamma/luminance LUT 31 with combined characteristics of the luminance correction LUT 13 (in terms of the aforementioned increase) shown in FIG. 9 and the reverse gamma LUT 11 (or the LED reverse gamma LUT 21), so that as in the first embodiment, even if the backlight luminance is low, it is possible to allow peak brightness to be perceived high while maintaining the depth of display, thereby enhancing contrast ratio, and also to prevent a tone jump (insufficient luminance) at high tone levels due to an insufficient backlight luminance, and further, as in the second embodiment, it is possible to inhibit the error from resulting in an adverse effect (noise in display), which increases as the backlight luminance decreases, thereby preventing a reduction in display quality.

Furthermore, as in the seventh embodiment, the LED output value correction section and the luminance correction LUT can be omitted, so that the amount of computation therefor, the circuit scale for such computation, etc., can be reduced, and further, the amount of computation, the circuit scale for such computation, etc., can be reduced in the LED output value calculation section 532, so that the size of memory can be reduced in the image memory 525, resulting in a scaled-down memory circuit.

10. Tenth Embodiment

<10.1 Overall Configuration and Operation>

The configuration and the operation of a liquid crystal display device 2 according to a tenth embodiment of the present invention are almost the same as those of the liquid crystal display device 2 according to the first embodiment, except that an LED drive processing section 54, in which area-active control is not performed, is included in place of the area-active drive processing section 5.

Specifically, the configuration of the liquid crystal display device 2 according to the tenth embodiment of the present invention is the same as that of the liquid crystal display device 2 according to the first embodiment shown in FIG. 1, except for components related to area-active control, and the backlight 3 is configured in the same manner as in the first embodiment shown in FIG. 2, except for components related to area-active control, therefore, the same components are denoted by the same characters, and any descriptions thereof will be omitted.

Note that for convenience of explanation, the backlight 3 is configured here as a straight-down type, as in the first embodiment, but because area-active control is not performed and the luminance is adjusted for the entire surface of the backlight, as will be described later, the backlight may be, for example, a so-called sidelight-type backlight with a light guide plate for emitting planar light from a light source provided at the end of the light guide plate, so long as it is a luminance-adjustable surface light source.

Furthermore, in the present embodiment, the configuration of the area-active drive processing section 5 differs in detail from the configuration in the first embodiment shown in FIG. 3. Concretely, the display luminance calculation section 514 and the luminance spread filter 14 shown in FIG. 3 are omitted, and further, the LED output value calculation section performs other operations related to area-active control differently. Hereinafter, with reference to FIG. 12, the configuration and the operation of the LED drive processing section in the present embodiment, which does not perform area-active control, will be described in detail.

<10.2 Configuration of the LED Drive Processing Section>

Figure 12:
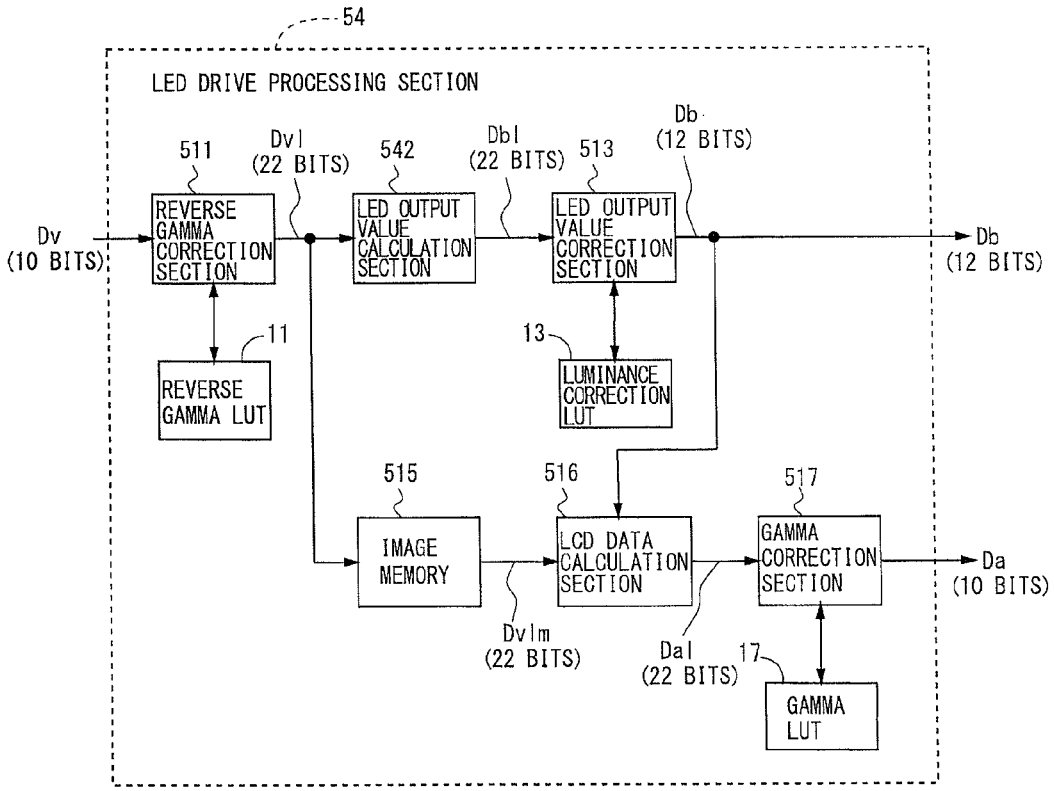
FIG. 12 is a block diagram illustrating a detailed configuration of an area-active drive processing section in a tenth embodiment of the present invention.

FIG. 12 is a block diagram illustrating a detailed configuration of the LED drive processing section 54 in the present embodiment. The LED drive processing section 54 includes an LED output value calculation section 542, in which area-active control is not performed, along with the same reverse gamma correction section 511, LED output value correction section 513, image memory 515, LCD data calculation section 516, and gamma correction section 517 as in the first embodiment, as components for performing predetermined processing, and also includes the same reverse gamma LUT 11, luminance correction LUT 13, and gamma LUT 17 as in the first embodiment, as components for storing predetermined data.

The LED output value calculation section 542 obtains LED data (emission luminance data) Dbl (with linear characteristics) indicating luminances upon emission of LEDs, in accordance with the luminance of the entire input image Dvl, without dividing the input image Dvl into a plurality of areas as described earlier. Examples of the method for determining LED output values include a method in which a determination is made on the basis of a maximum luminance value Ma among pixels in the input image Dvl, a method in which a determination is made on the basis of a mean luminance value Me among the pixels, and a method in which a determination is made on the basis of a value obtained by weighted averaging of the maximum luminance value Ma and the mean luminance value Me among the pixels, as described earlier. In this manner, the LED output value calculation section 542 operates in the same manner as in the first embodiment where there is only one area, and therefore other descriptions will be omitted.

As in the first embodiment, the LED output value correction section 513 corrects the LED data Dbl obtained by the LED output value calculation section 542 such that the luminance in the range from the intermediate value to near the maximum value shifts to a higher degree, and outputs the result as LED data Db. Note that the LED data Db is directly provided to the LCD data calculation section 516, but the backlight 3 here is a surface light source, which emits uniform light, and therefore it is not necessary to perform computation related to luminance spread. For this reason, the display luminance calculation section 514 and the luminance spread filter 14 shown in FIG. 3 are omitted.

<10.3 Effect>

In this manner, as in the first embodiment, the LED output value correction section 523 in the present embodiment corrects the LED data Dblb obtained by the LED output value calculation section 522 with reference to the luminance correction LUT 13 shown in FIG. 4, such that the luminance in the range from the intermediate value to near the maximum value shifts to a higher degree. Thus, as in the first embodiment, even if the backlight luminance is low, it is possible to allow peak brightness to be perceived high while maintaining the depth of display, thereby enhancing contrast ratio, and also to prevent a tone jump (insufficient luminance) at high tone levels due to an insufficient backlight luminance, thereby preventing a reduction in display quality.

Note that the present embodiment has been described as having the same configuration, actions, and effects as in the first embodiment, except that area-active control is not performed, but assuming that area-active control is not performed in the second through ninth embodiments, the present embodiment has the configuration of each of these embodiments, except components related to area-active control, as described above, and therefore has the same actions and effects as in the embodiments.

The present invention can be applied to image display devices including backlights, and is suitable for image display devices, such as liquid crystal display devices, which have the function of controlling backlight luminance area by area.

The invention claimed is:

1. An image display device with a function of controlling a backlight luminance, comprising:

a backlight including a plurality of light sources;

a display panel including a plurality of display elements for transmitting light from the light sources therethrough in order to display a plurality of pixels;

an emission luminance calculation section for obtaining emission luminance data indicating a luminance upon emission of the light sources, on the basis of an input image including a plurality of pixels to be displayed with predetermined tones;

a display data calculation section for obtaining display data in accordance with light transmittances of the display elements, on the basis of the input image and the emission luminance data obtained by the emission luminance calculation section;

a panel driver circuit for outputting signals for controlling the light transmittances of the display elements to the display panel, on the basis of the display data; and a backlight driver circuit for outputting signals for controlling the luminance of the light sources to the backlight, on the basis of the emission luminance data, wherein, the emission luminance calculation section includes:

an output value calculation section for performing predetermined computation on the tones of the pixels included in the input image, thereby calculating the emission luminance data corresponding to the pixels, a luminance correction section for correcting the input image to be provided to the output value calculation section or the emission luminance data calculated by the output value calculation section, such that values within a predetermined range of the emission luminance data to be provided to the display data calculation section are increased, and the emission luminance calculation section divides the input image into a plurality of areas and obtains emission luminance data that indicates luminances upon emission of the light sources corresponding to the areas, on the basis of the input image.

2. The image display device according to claim 1, wherein the luminance correction section adds a predetermined increment to values within a range from an intermediate value to near a maximum value of the emission luminance data to be provided to the display data calculation section.

3. The image display device according to claim 2, wherein the increment added to the values within said range by the luminance correction section is determined so as to be minimized at the intermediate value and near the maximum value, the intermediate value being a value greater than or equal to a median of the emission luminance data to be provided to the display data calculation section.

4. The image display device according to claim 1, wherein the luminance correction section adds a predetermined increment to values within a range from near a minimum value to an intermediate value of the emission luminance data to be provided to the display data calculation section.

5. The image display device according to claim 4, wherein the increment added to the values within said range by the luminance correction section is determined so as to be maximized near the minimum value of the emission luminance data to be provided to the display data calculation section, and minimized at the intermediate value.

6. The image display device according to claim 1, wherein the luminance correction section adds a predetermined increment to values within a range from near a minimum value to a first intermediate value of the emission luminance data to be provided to the display data calculation section, and also adds a predetermined increment to values within a range from a second intermediate value to near a maximum value, the second intermediate value being a value greater than or equal to the first intermediate value.

7. The image display device according to claim 6, wherein the increment added to the values within said range by the luminance correction section is determined so as to be maximized near the minimum value of the emission luminance data to be provided to the display data calculation section, and minimized at the first intermediate value, the second intermediate value, and near the maximum value.

8. The image display device according to claim 1, wherein, the emission luminance calculation section performs a reverse gamma correction on an input image provided from outside the device, and the display data calculation section includes:

image memory for holding the input image provided from outside the device for a predetermined time period;

a display reverse gamma correction section for performing a reverse gamma correction on an input image provided from the image memory after a lapse of the time period; and a display data output section for obtaining the display data on the basis of the input image subjected to the reverse gamma correction by the display reverse gamma correction section and the emission luminance data obtained by the emission luminance calculation section.

9. The image display device according to claim 8, wherein, the emission luminance calculation section further includes an emission luminance reverse gamma correction section for performing the reverse gamma correction on the input image provided from outside the device, and the output value calculation section calculates the emission luminance data by performing predetermined computation on tones of a plurality of pixels included in the input image subjected to the reverse gamma correction by the emission luminance reverse gamma correction section.

10. The image display device according to claim 9, wherein, the emission luminance reverse gamma correction section performs a correction with reference to a first table indicating a correspondence between the tones of the pixels included in the input image and tones of pixels to be obtained by the reverse gamma correction, and the luminance correction section performs a correction with reference to a second table indicating a correspondence between the tones of the pixels included in the input image and tones of pixels to be obtained by performing a correction for increasing the values within said range of the emission luminance data.

11. The image display device according to claim 8, wherein, the luminance correction section simultaneously subjects the input image provided from outside the device to the reverse gamma correction and the correction for increasing the values within said range of the emission luminance data, and the output value calculation section outputs the emission luminance data calculated by performing predetermined computation on tones of a plurality of pixels included in the input image corrected by the luminance correction section.

12. The image display device according to claim 11, wherein the luminance correction section performs a correction with reference to a single table indicating a correspondence between the tones of the pixels included in the input image and tones of pixels to be obtained by performing the reverse gamma correction and the correction for increasing the values within said range of the emission luminance data.

13. A method for controlling an image display device having a function of controlling a backlight luminance and provided with a backlight including a plurality of light sources, and a display panel including a plurality of display elements for transmitting light from the light sources therethrough in order to display a plurality of pixels, the method comprising:

an emission luminance calculation step of obtaining emission luminance data indicating a luminance upon emission of the light sources, on the basis of an input image including a plurality of pixels to be displayed with predetermined tones;

a display data calculation step of obtaining display data in accordance with light transmittances of the display elements, on the basis of the input image and the emission luminance data obtained by the emission luminance calculation step;

a panel drive step of outputting signals for controlling the light transmittances of the display elements to the display panel, on the basis of the display data; and a backlight drive step of outputting signals for controlling the luminance of the light source sources to the backlight, on the basis of the emission luminance data, wherein, the emission luminance calculation step includes:

an output value calculation step of performing predetermined computation on the tones of the pixels included in the input image, thereby calculating the emission luminance data corresponding to the pixels, a luminance correction step of correcting the input image for the output value calculation step or the emission luminance data calculated by the output value calculation step, such that values within a predetermined range of the emission luminance data for the display data calculation step are increased, and in the emission luminance calculation step, the input image is divided into a plurality of areas and emission luminance data that indicates luminances upon emission of the light sources corresponding to the areas is obtained on the basis of the input image.

* * * * *